United States Patent [19]

Engels

[11] 4,059,232

[45] Nov. 22, 1977

[54] STIRRING OR AGITATING MILLS

[75] Inventor: Kaspar Engels, Mannheim, Germany

[73] Assignee: Draiswerke GmbH, Mannheim, Germany

[21] Appl. No.: 639,889

[22] Filed: Dec. 11, 1975

[30] Foreign Application Priority Data

Dec. 12, 1974 Germany ..... 2458841

[51] Int. Cl.[2] ..... B02C 23/36

[52] U.S. Cl. ..... 241/46.17; 241/67; 241/172

[58] Field of Search ..... 241/46.11, 46.15, 46.17, 241/65, 66, 67, 170, 171, 172

[56] References Cited

U.S. PATENT DOCUMENTS

| | | | |
|---|---|---|---|
| 1,290,734 | 1/1919 | Goodhue | 241/67 |
| 2,671,646 | 3/1954 | Lindsey | 241/66 |
| 3,199,792 | 8/1965 | Norris, Jr. | 241/172 |
| 3,311,310 | 3/1967 | Engels et al. | 241/172 |
| 3,423,032 | 1/1969 | Eckert | 241/15 |
| 3,511,447 | 5/1960 | Brizon | 241/172 |
| 3,770,214 | 11/1973 | Gabor | 241/46.17 |
| 3,993,254 | 11/1976 | Bicik et al. | 241/67 |

FOREIGN PATENT DOCUMENTS

| | | | |
|---|---|---|---|
| 1,276,985 | 9/1968 | Germany | 241/15 |
| 1,214,516 | 4/1966 | Germany | |
| 1,211,906 | 3/1966 | Germany | |
| 1,233,237 | 1/1967 | Germany | |

*Primary Examiner*—Granville Y. Custer, Jr.
*Attorney, Agent, or Firm*—Browdy and Neimark

[57] ABSTRACT

A stirring or agitating mill has a grinding vessel partially filled with grinding bodies. The vessel is substantially surrounded by a cooling jacket. A rotationally drivable and internally coolable agitator is disposed in the grinding vessel. The walls of the grinding vessel and/or the agitator have heat-dissipating, gently curving projections therein extending helically or parallel to the direction of the longitudinal axis of the vessel. Means may be present within the agitator to direct the coolant against the inside of the projections.

16 Claims, 2 Drawing Figures

STIRRING OR AGITATING MILLS

FIELD OF THE INVENTION

The present invention relates to stirring or agitating mills consisting of a grinding vessel which is partly filled with grinding bodies or elements and is provided with an inlet and an outlet for the material to be ground and with an outer cooling jacket through which a coolant flows, the vessel containing a rotationally drivable and coolable agitator.

BACKGROUND OF THE INVENTION

Agitating mills of the kind described above are known. They all have the common feature that the major part of the driving energy for the agitator is converted into heat. In the vast majority of applications this heat is undesirable. In many applications the reason that certain materials cannot be ground in agitator mills of this kind is in fact because of the danger of overheating. On the other hand, in many such cases, if a good grinding effect is to be achieved, it is necessary to introduce considerable grinding energy into the mixture of material being ground and grinding elements.

It is known from German Pat. No. 1,211,906, for annular discs acting as agitator elements to be fastened eccentrically on the agitator shaft in an agitating mill, these annular discs being in the form of a helical surface. In this way it is intended to effect compaction of the grinding bodies, that is to say to improve the grinding effect by preventing the grinding bodies from passing exclusively into a suspended state in the stream of material being ground and grinding bodies.

In another form of agitating mill, known from German Pat. No. 1,214,516, a closed cylinder extends centrally within the entire length of the grinding vessel, and the grinding elements are disposed in the annular space formed by the outer wall of the cylinder and the inner wall of the grinding vessel. By this means, it is intended to ensure that as a result of their approximately equal distance from the agitator axis the grinding bodies will have approximately the same velocity, so that their comminuting action will be substantially equal. In this way, it is intended to avoid great differences in the fineness of the processed material.

In another form of agitating mill known from German Auslegeschrift 1,233,237, exchangeable inserted rings, bars or cylinders may be fastened on the inner wall of the grinding vessel and carry rods which are so disposed as to be situated between the rods of the rotating cylinder which serve as agitator tools. By this means it is intended to prevent the grinding bodies from rotating together with the material being ground, in which case the grinding bodies would no longer transmit to one another the impulses received from the agitator tools, which would result in decreased grinding output. The exchangeability of the rods serves to permit rapid cleaning.

An agitating mill is also known from German Auslegeschrift 1,276,985, which works as a friction mill, that is to say an agitator mill having a compact package of grinding bodies, in which mill the agitator consists of a cylindrical roller body which is provided with at least one annular projection of larger diameter. Particularly in friction mills this measure serves to provide an adequately large friction surface between the agitator and the grinding bodies which are not freely movable in the material being ground.

The problem sought to be solved by the present invention is that of so developing a stirring or agitating mill of the kind described above that, on the one hand, considerable grinding energy is introduced locally into the mixture of the material being ground and the grinding bodies, and that, on the other hand, good dissipation of heat is effected, particularly at these points.

SUMMARY OF THE INVENTION

According to the present invention there is provided a stirring or agitating mill comprising a grinding vessel which is partly filled with grinding bodies, and which has an inlet and an outlet for the material to be ground and an external cooling jacket through which a coolant flows. A rotationally drivable, coolable agitator is disposed in the grinding vessel. The inner wall of the grinding vessel and/or the outer wall of the agitator is or are provided with at least one heat-dissipating projection extending in the direction of the longitudinal axis of the grinding vessel. By constructing the mill in accordance with the present invention, it is ensured that grinding energy is introduced in a pulsating manner into the mixture of the material being ground and the grinding bodies. On the other hand, at the points where particularly great energy is introduced, that is to say the projections, heat is dissipated particularly evenly. Through the direct discharge of heat in the region of the projections it is possible to increase considerably the grinding energy in the region of the projections, this being achieved, depending on the shape of the projections, by correspondingly high rotational speeds of the agitator in the case of material to be ground which has a low viscosity and of small diameter grinding bodies, or by means of lower rotational speeds in the case of material of higher viscosity and of larger diameter grinding bodies.

For grinding of material of low viscosity with relatively small grinding bodies, it is expedient to provide the projection or projections with relatively low pitches in the longitudinal direction, while for the main field of application of the agitator mill, namely the grinding of material of relatively high viscosity with correspondingly larger grinding bodies and with lower rotational speeds, relatively high pitches in the longitudinal direction will be selected for the projections and in such cases a plurality of projections will then always be provided on the agitator and/or on the grinding vessel.

According to one advantageous feature of the present invention, the projections extend parallel to the longitudinal axis of the agitating mill. In order, on the one hand, to avoid unsteady running and, on the other hand, to be able to control the movements of the material being ground and of the grinding bodies, according to another advantageous feature of the present invention, it is advantageous for the projection or projections to extend helically, in which case the projections may have a pitch of from 75° to 85° in relation to a cross-sectional plane of the agitating mill.

The height of the projection or projections on the agitator is advantageously equal to from one to ten times the diameter of the largest grinding body used. The height of the projection or projections on the grinding vessel is advantageously equal to from one to five times the diameter of the largest grinding body used. When the grinding vessel and the agitator both have projections, the radial distance between the apices of each projection on the grinding vessel and the apices of each projection on the agitator is between five and ten times the diameter of the largest grinding body used. Depending on the viscosity of the material being ground and the rotation speed of the agitator, the diameter of the grinding bodies is, for example, between 0.2 and 3 mm for material of low viscosity and up to 6 mm, and in limit cases even 8 mm, for material of high viscosity. If the height of the projections lies within the range indicated, it is ensured that, on the one hand, a high grinding energy will be introduced by the projections into the material being ground, without, on the other hand, head spaces being formed between two neighboring projections on the agitator or on the grinding vessel. In addition, the fact that the projections are relatively flat ensures that, despite pulsating and very frequent loading and unloading of grinding bodies and material being ground, even at low rotational speeds, an intensive pulsating stressing of the material being ground is achieved without extreme peak loads occurring. This effect is further considerably assisted if, according to another feature of the invention, the projection or projections have no sharp bends in their cross-sectional shape, and if in particular the projection or projections have no surface regions which extend radially in relation to the agitator and against which grinding bodies could strike in a direction normal to this surface region, which would lead locally to considerable generation of heat. In particular, it is advantageous for all normals to the projections to extend at an angle to the associated radii of the agitator of less than 90°, because it is thereby ensured that the direction in which the grinding bodies impinge on the projections will always form an angle, in relation to the normals, which is definitely greater than zero.

Cooling can be further improved if the projection or projections are made concave on their side remote from the interior of the grinding vessel, so that the coolant always acts on the inner side of the projections. This cooling effect can be further improved if means for guiding the coolant into the projections are provided. As a rule, it will be expedient for the number of projections on the grinding vessel to be different from the number of projections on the agitator, while it is particularly expedient for the number of projections on the grinding vessel to be greater than the number of projections on the agitator.

In another aspect of the present invention, an agitating mill according to the present invention is characterized by shapes of the projections on the agitator and those on the grinding vessel which apply opposite axial impulses to the mixtures of material being ground and the grinding bodies. The flotation effect of the grinding bodies can be influenced in this way. In an ordinary agitating mill having a rotating agitator and a stationary grinding vessel, the projections on the agitator and those on the grinding vessel extend for this purpose in the same direction of rotation, although they do not by any means necessarily also have the same pitch.

Particularly good cooling conditions are achieved if the projection or projections are formed from the wall of the grinding vessel or from the wall of the agitator, since in this case the transfer of heat to the coolant is effected without additional heat transfer resistance.

BRIEF DESCRIPTION OF THE DRAWINGS

Embodiments of the invention will now be described by way of example and with reference to the accompanying drawings, in which.

DETAILED DESCRIPTION OF PREFERRED EMBODIMENTS

Figure 1:
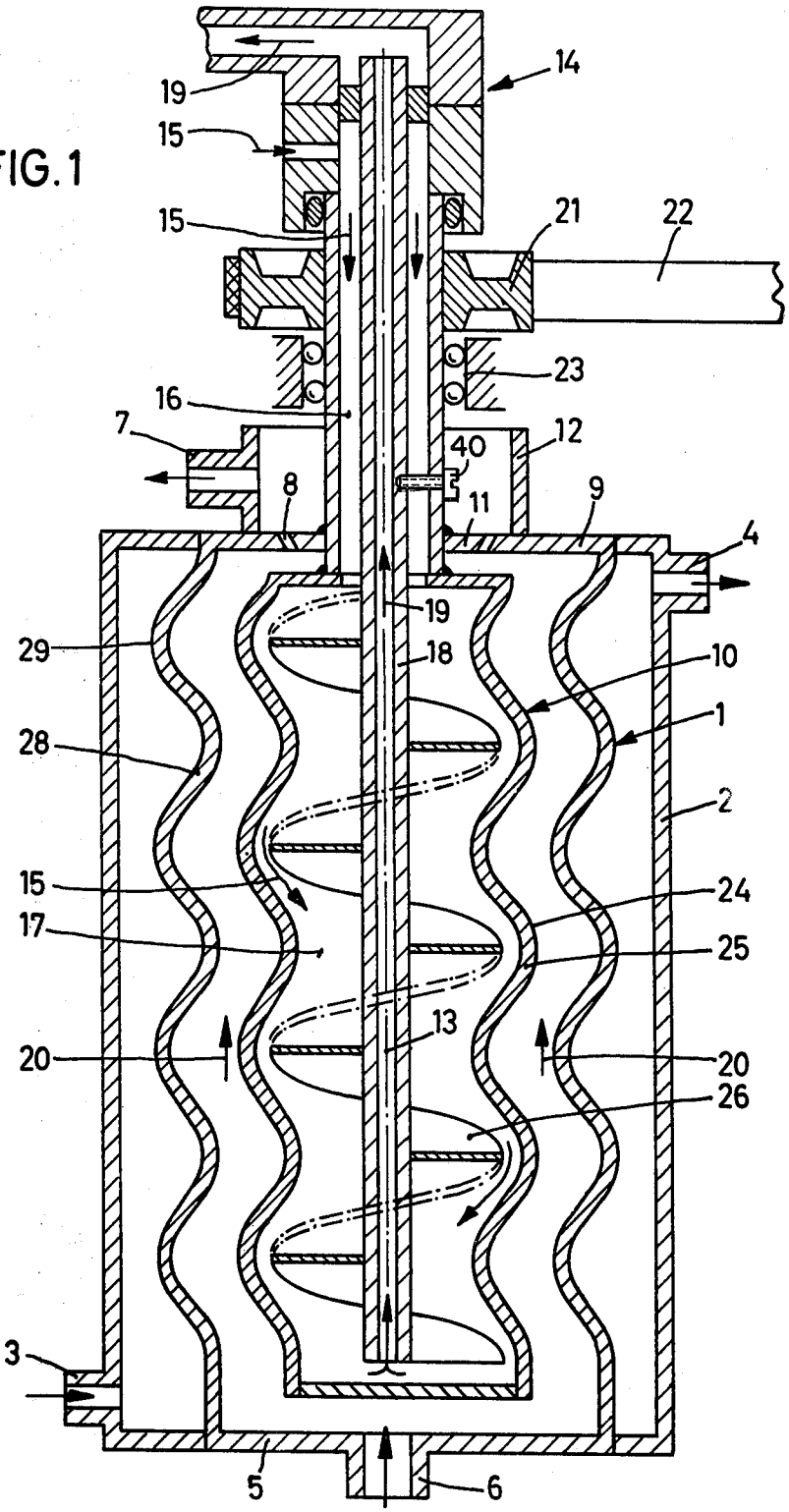
FIG. 1 is a central longitudinal section of a vertical agitating mill adapted to be continuously operated.

The agitating mill of the present invention comprises, as shown in FIG. 1, an upright grinding vessel 1 which is for the most part closed at the top and which over the greater part of its approximately axially extending outer periphery is surrounded by a cylindrical cooling jacket 2 to which cooling liquid is supplied through a (bottom) coolant connection 3, the cooling liquid being taken off through a (top) coolant connection 4.

Material to be ground is fed to the grinding vessel 1, which is closed at the bottom by a base-plate 5, by way of a material inlet 6 provided in the said base-plate, and this material leaves the grinding vessel after the grinding operations by way of a material outlet 7, upstream of which a separating device holding back the grinding bodies (not shown) is disposed. This separating device is formed by an annular gap 8 provided between an upper closure plate 9 of the grinding vessel 2 and a disc 11 rotating with an agitator 10. On the upper closure plate 9 is mounted a cylindrical tube 12, below the upper edge of which the outlet 7 for the ground material is disposed, so that the material passing through the annular gap 8 collects in the cylindrical tube 12 and leaves the latter by way of the outlet 7. The width of the annular gap 8 is in any case smaller than the smallest grinding bodies used. A separating device of this kind is described in U.S. Pat. No. 3,311,310, hereby incorporated by reference.

The hollow agitator 10, whose longitudinal axis 13 coincides with the axis of the grinding vessel 1, is provided at its upper end, above the grinding vessel 1, with a sealing head 14, through which a coolant is supplied in the direction of the arrows 15, through an annular channel 16 concentric to the longitudinal axis 13, to the interior 17 of the agitator 10. In the region of the bottom end of the agitator the coolant flows into a return pipe 18 disposed concentrically to the longitudinal axis 13 and leaves the sealing head 14 in the direction of the arrows 19. Cooling is therefore effected counter-current to the direction 20 in which the material being ground flows through the grinding vessel 1.

Above the top closure plate 9 the agitator 10 carries a belt pulley 21 by means of which the agitator 10 is driven by a motor (not shown) with the aid of a drive belt 22. Above the upper closure plate 9 the agitator 10 is also mounted in bearings 23 in an overhung arrangement.

The portion of the agitator 10 situated in the grinding vessel has approximately the external shape of the rotor of an eccentric worm pump, that is to say, the external generatrices of the agitator 10 have in axial longitudinal section the shape of the sine (or cosine) curve. The outward apperance is therefore as if the agitator 10 had projections 24 extending helically with a constant pitch around an imaginary cylinder. As can be seen in FIG. 1, the agitator 10 is provided with a single-thread projection 24. Since the wall 25 of the agitator 10 has an approximately constant thickness over the entire length of the agitator, the shape of the interior space 17 of the agitator 10 is approximately the same as its outer shape. On the return pipe 18 is fastened a guide plate 26 which extends helically and whose pitch is equal in direction and height to the pitch of the projection 24, while the diameter of this guide plate is such that it extends to a point close to the inside of the wall 25 of the agitator 10. The coolant is thus forced to pass close to and along the inside of the wall 25. For assembly purposes this guide plate 26 can be introduced into the agitator 10 by rotating it as it is inserted. In this embodiment it is suitable to connect the guide plate 26 with the wall 25 and/or to connect the return pipe 18 with that portion of the agitator 10 supported by bearings 23 as, for example, by means of screw 40.

The wall 28 of the grinding vessel 1 is shaped similarly to the agitator 10, that is to say it has projections 29 extending helically around it. In FIG. 1, the wall 28 of the grinding vessel 1 is provided with a single-thread projection 29 similarly to the agitator 10; either or both the wall 29 and the agitator 10 may, however, be provided with multi-thread projections. The direction of rotation of the pitch of the projection 24 and that of the projection 29 is expediently such that the impulses applied in the axial direction by these projections to the mixture of material being ground and the grinding bodies cancel one another. Consequently, the pitches of the projections on the agitator 10 and on the vessel wall 28 expediently have the same direction of rotation.

Figure 2:
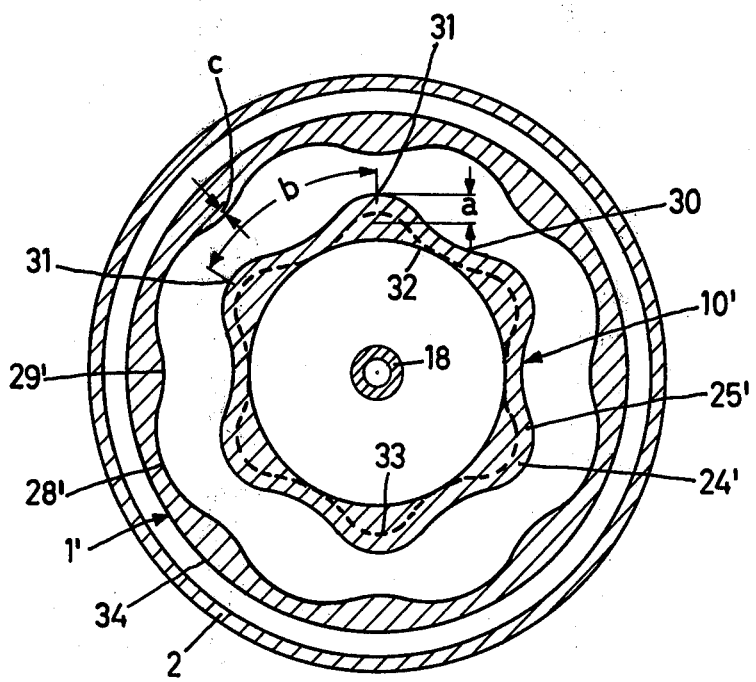
FIG. 2 is a cross-section of a second embodiment of an agitating mill.

The agitating mill shown in FIG. 2 is in principle similar in construction to that illustrated in FIG. 1 and described above, so that to that extent reference can be made to the description given above. In particular, identical parts are given identical references. The difference from the agitating mill shown in FIG. 1 consists in that the agitator 10' is provided with a plurality of projections 24', in this embodiment six projections 24', which are disposed helically on the agitator 10' with a pitch of from 75° to 85° in relation to the cross-sectional plane (that is to say the plane of the drawing). On the wall 28' of the grinding vessel 1' are disposed eight projections 29', likewise with a high pitch in relation to the cross-sectional plane and in the same direction of rotation as for the agitator 10'. Since the apex height *a* of the projections 24' is relatively low in relation to the bottom 30 of the projection on the agitator 10', in comparison with the peripheral distance *b* between the apices 31 of two neighboring projections 24', so that the projections 24' have a relatively shallow curvature, they need not be made concave, that is to say the interior of the agitator 10' can be formed by a cylinder 32. Because of the good thermal conductivity of the metal of which the agitator 10' is made, aequate dissipation of heat from the region of the projection apices 31 is ensured. The dissipitation of heat is obviously further improved if the projections 24' are made concave, as indicated by the dashed lines 33. The same applies to the projections 29' on the wall 28' of the grinding vessel 1', whose apex height *c* is regularly smaller than the apex height *a* of the projections 24' on the agitator 10'. In the case of the grinding vessel 1' its outer boundary wall 34 can therefore be in the form of a regular cylinder.

It should be expressly emphasized that the measures according to the present invention are applicable to stirring or agitating mills which are adapted to be operated continuously or discontinuously and which may have a vertically, horizontally, or obliquely disposed agitator.

It will be obvious to those skilled in the art that various changes may be made without departing from the scope of the invention and the invention is not to be considered limited to what is shown in the drawing and described in the specification.

What is claimed is:

1. A stirring or agitating mill using grinding bodies, for stirring or grinding material, comprising:

a grinding vessel adapted to be partly filled with the grinding bodies and having an inlet and an outlet for the material to be ground;

an external cooling jacket substantially surrounding said grinding vessel; and a rotationally drivable, coolable agitator disposed within said grinding vessel, wherein each of the inner wall of said grinding vessel and the outer wall of said agitator is provided with at least one helically extending heat-dissipating projection.

2. A mill in accordance with claim 1 wherein each projection has a pitch of 75° to 85° in relation to the cross-sectional plane of the mill.

3. A mill in accordance with claim 1 wherein the radial height of each projection on said agitator is between one and ten times the diameter of the largest grinding body used in the grinding vessel.

4. A mill in accordance with claim 1 and wherein the radial height of each projection on said grinding vessel is from one to five times the diameter of the largest grinding body used therein.

5. A mill in accordance with claim 1 wherein each projection is free of sharp angular bends in the cross-sectional shape thereof.

6. A mill in accordance with claim 5 wherein all normals to each projection extend at an angle of less than 90° to a plane perpendicular to the longitudinal axis of said grinding vessel.

7. A mill in accordance with claim 5, wherein the cross-section of each said projection is a curve and wherein the curvature of the projections on said grinding vessel and on said agitator, in the cross-sectional plane of the mill, are shallow with respect to imaginary cylinders respectively inscribing or circumscribing the projections.

8. A mill in accordance with claim 1 wherein none of said projections has a surface region which extends radially in relation to said agitator or said grinding vessel.

9. A mill in accordance with claim 1, wherein each of said projections is made concave on the side thereof remote from the interior of said grinding vessel.

10. A mill in accordance with claim 9, further including means for guiding coolant into the interior of each said projection.

11. A mill in accordance with claim 1 wherein the number of said projections on said grinding vessel is different from the number of said projections on said agitator.

12. A mill in accordance with claim 11, wherein the number of said projections on said grinding vessel is greater than the number of said projections on said agitator.

13. A mill in accordance with claim 1, wherein each said projection in said agitator and said grinding vessel is formed by shaping the wall of said agitator and said grinding vessel.

14. A mill in accordance with claim 1, wherein the radial distance between the apices of each projection on said agitator and the apices of each projection on said grinding vessel is between 5 and 10 times the diameter of the largest grinding bodies used.

15. A mill in accordance with claim 1 wherein the surface of the projections has, in axial longitudinal section, the shape of a sine curve.

16. A mill in accordance with claim 1, wherein said agitator is hollow and each projection thereon is made concave on the interior side thereof, and said agitator includes a coolant inlet and a coolant outlet, and further including means for guiding coolant into the interior of each said projection.

* * * * *